United States Patent [19]

Nickerson

[11] 4,059,126

[45] Nov. 22, 1977

[54] SOLAR ACTUATED SIPHON DRAIN

[75] Inventor: Malcolm Horace Nickerson, Chagrin Falls, Ohio

[73] Assignee: The B. F. Goodrich Company, Akron, Ohio

[21] Appl. No.: 714,867

[22] Filed: Aug. 16, 1976

[51] Int. Cl.[2] ..... F16L 43/00

[52] U.S. Cl. ..... 137/142; 417/52

[58] Field of Search ..... 137/142, 147, 151; 417/52

[56] References Cited

U.S. PATENT DOCUMENTS

| | | | |
|---|---|---|---|
| 2,688,922 | 9/1954 | Bonaventura | 417/52 |
| 3,757,812 | 9/1973 | Duncan | 137/142 |

*Primary Examiner*—Robert G. Nilson

*Attorney, Agent, or Firm*—James R. Lindsay

[57] ABSTRACT

An enclosed container has a chamber in which a gaseous fluid is heated as by solar radiation and a first valve permits some of the fluid to be ejected as it expands during heating. The remaining fluid is then cooled as by clouds blocking the sun or during the night and a subatmospheric pressure is developed in the chamber. Through a second valve in the container this negative pressure is communicated to a siphon having an inlet immersed in liquid at an upper level and an outlet closed by a third valve at a lower level. The subatmospheric pressure causes the siphon to be filled with liquid and the weight of the liquid opens the third valve at the outlet causing the siphon to operate. The second valve prevents the loss of subatmospheric pressure in the siphon. The siphon may be used to automatically drain water from areas such as flat roofs of buildings.

8 Claims, 7 Drawing Figures

FIG. 1
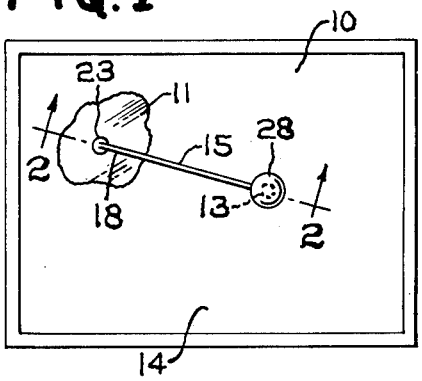
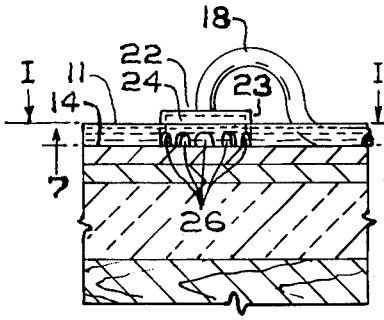
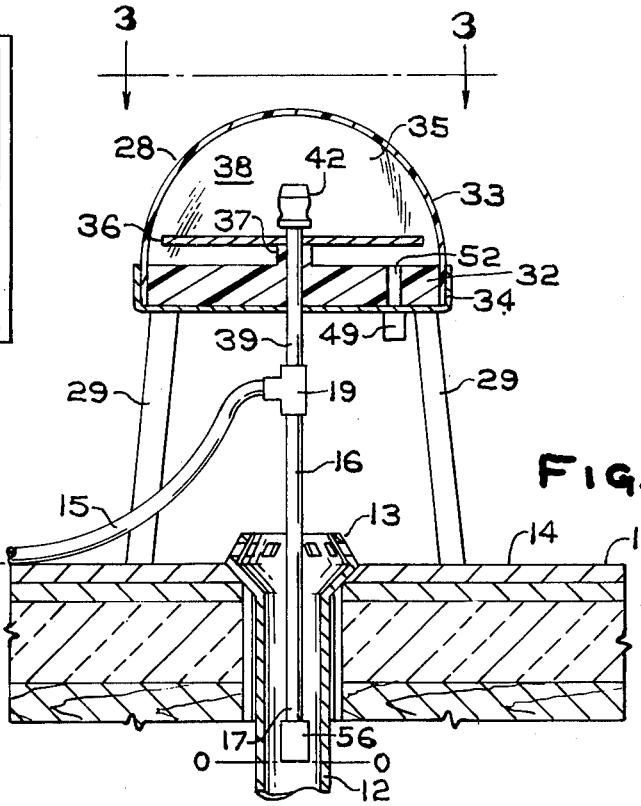
FIG. 2
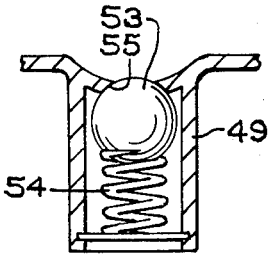
FIG. 4
FIG. 3
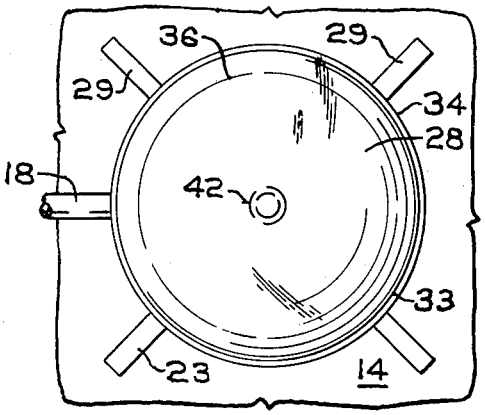
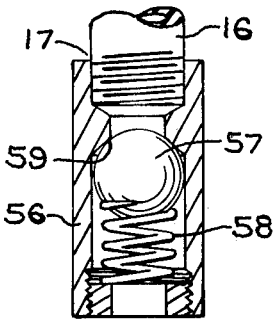
FIG. 6
FIG. 5
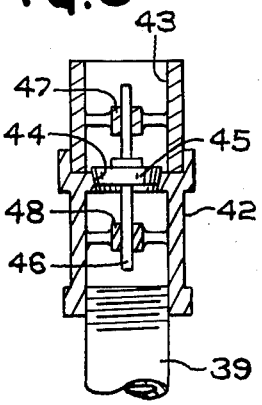
FIG. 7
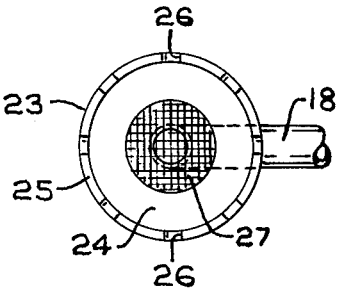

SOLAR ACTUATED SIPHON DRAIN

BACKGROUND OF THE INVENTION

This application relates generally to drains and apparatus for priming a siphon and particularly to apparatus utilizing solar energy to actuate the siphon. The present invention has a particular utility for draining standing water from roofs of commercial buildings where water collects in ponds following a rain or melting of ice and snow.

Although flat roof buildings have drains, water collects on the roofs during rainstorms at low-lying positions spaced from the drains. Also, during cold weather ice frequently builds up around the drain inlets interfering with normal drainage during a thaw, causing water to collect in ponds adjacent to the drain inlets. The ponds of water not only overload the roofs but also cause them to leak. The use of a pump or conventional siphon device to drain ponds of water from a flat roof is not entirely satisfactory because the siphon requires priming by a person or by a power driven primer and the pumps require a power supply and a person to operate the apparatus when needed. Solar power has been utilized to for venting roofs, but has not been utilized to actuate a siphon to drain standing water from flat roofs.

SUMMARY OF THE PRESENT INVENTION

The present invention provides apparatus which utilizes solar energy "fill" a siphon with fluid and thereby actuate the siphon. The apparatus has a valved hermetically sealed chamber in which the pressure is reduced upon heating and cooling of the gaseous fluid medium in the chamber. The reduced pressure is communicated to the siphon and causes liquid from an upper level to be transferred into the siphon. Valves between the siphon and chamber, between the chamber and the atmosphere, and in the siphon control the passage of gaseous and liquid fluids to provide subatmospheric pressure in the chamber and communicate it to the siphon. When the siphon is primed sufficiently, the valves operate to start the flow of liquid through the siphon.

The preferred embodiment of the present invention provides an automatic self-actuated drainage system for removing standing water from a roof of a building. The drainage system includes a container having a hermetically sealed chamber. Tubular members of the siphon extend from an inlet immersed in the standing water to the drain and down the drain to an outlet at a lower level. A valve at the outlet seals the outlet when subatmospheric pressure is applied to the siphon and opens when the siphon is "filled" with liquid.

The siphon is connected to the chamber through a check valve for containing positive or above-atmospheric pressure in the chamber but opening to communicate subatmospheric pressure to the siphon. Another valve in the chamber opens to exhaust air at above atmospheric pressure from the chamber caused by solar heating of the air. Then upon cooling of the remaining air in the chamber the pressure drops to subatmospheric which causes the valve between the chamber and siphon to open reducing the pressure in the siphon to provide for movement of the water into the siphon at the inlet. After the siphon is "filled" the weight of the water opens the valve at the outlet and the siphon is actuated and will continue to transfer water until the water level at the upper level is so low the inlet is no longer immersed in the water.

DESCRIPTION OF THE DRAWINGS

The further objects and advantages of this invention will become further apparent from the following description and the accompanying drawings wherein:

FIG. 1 is a schematic plan of a roof of an industrial building showing apparatus embodying the invention.

FIG. 2 is a fragmentary sectional view of the apparatus shown in FIG. 1 taken along the plane of line 2—2 in FIG. 1 with parts being broken away.

FIG. 3 is a fragmentary plan view of part of the apparatus of the invention taken along the plane of line 3—3 of FIG. 2.

FIG. 4 is a cross-sectional view of the container exhaust valve.

FIG. 5 is a cross-sectional view of the container siphon valve.

FIG. 6 is a cross-sectional view of the siphon outlet valve.

FIG. 7 is a bottom view of the inlet and strainer taken along the plane of line 7—7 of FIG. 2.

DETAILED DESCRIPTION OF THE PREFERRED EMBODIMENT

As set forth above the present invention relates to a solar actuated siphon drain which uses solar energy for priming a siphon and has particular application to the draining of standing water from a flat roof. There is illustrated hereinafter the manner in which the present invention is employed for draining water from a roof. However, from the description which follows, the manner in which this invention may be applied to numerous types of systems will become readily apparent to those of ordinary skill in the art.

Referring now to FIG. 1 there is shown a schematic view of a commercial building having a flat roof 10 of the type on which ponds of standing water 11 occur due to lack of proper drainage of the roof after a rain or due to damming of the standing water by melting ice and snow. As shown in FIG. 2 a roof drain pipe 12 having a roof drain strainer 13 extends through the roof 10 at a position spaced from the standing water 11. The roof surface 14 at the standing water 11 may be lower than the roof surface at the drain pipe 12 by an amount (*h*) causing the pond of standing water to form on the roof.

In accordance with this invention a siphon 15 connects the standing water 11 with the drain pipe 12 and has a first tubular member or discharge hose 16 extending downwardly into the drain pipe to an outlet end 17 at a lower level 0—0 below the upper level I—I of the standing water as shown in FIG. 2. The siphon 15 also includes a second tubular member or inlet hose 18 connected to the discharge hose 16 by suitable means such as a T connection 19 and extending away from the drain pipe 12 to an inlet end 22 immersed in the standing water 11. As shown in FIGS. 2 and 7, the inlet end 22 may include a strainer 23 in the form of a cup having a base 24 and a projecting supporting edge 25 with circumferentially spaced-apart openings 26 through which fluid may pass. The inlet end 22 of the inlet hose 18 is mounted on the base 24 for transferring fluids such as water from the space within the strainer 23 through an opening in the base and into the inlet hose. A screen 27 may be mounted over the entrance to the inlet hose 18 as shown in FIG. 7.

A container 28, mounted on legs 29, rests on the roof surface 14 above or adjacent to the drain pipe 12. The container 28 may include a circular plate 32 and a transparent dome 33 of hard, high impact, plastic material held together in a metal case 34 or other suitable retainer. The respective peripheral edges of the plate 32 and the transparent dome 33 are in substantially airtight sealing relationship with each other. If desired, the transparent dome 33 may be bonded directly to circular plate 32, eliminating metal case 34. A suitable bonding agent may be used to insure an airtight seal along the peripheral joining of plate 32 and the transparent dome 33.

In its preferred embodiment the dome 33 permits infrared radiation from the sun to easily pass into a chamber 35 within the dome and plate 32. Within the chamber 35 there is disposed a black body, preferably in the form of a thin gauge blackened aluminum disc 36 which is mounted on a central support 37 projecting upwardly and away from the plate 32 as shown in FIG. 2. The disc 36 serves to absorb radiant energy from the sun and to transfer the radiant energy by conduction to a gaseous fluid medium such as air 38 within the chamber 35. The chamber 35 and siphon 15 are connected by a tubular member such as pipe 39 extending from the T connection 19 through the case 34, plate 32, central support 37, and disc 36 into the chamber. The pipe 39 is in sealing engagement with the case 34 and plate 32 to maintain the hermetically sealed chamber 35. At the end of the pipe 39 extending into chamber 35, a first valve means such as container siphon check valve 42 is mounted on the pipe 39. Referring to FIG. 5, the check valve 42 may be of the type having a passage 43 with a valve seat 44 and a valve member 45 mounted on a central pin 46 for vertical movement in bushings 47 and 48. The check valve 42 is sensitive to the pressure within the chamber 35 and expanding gaseous fluid pressure such as air pressure within the chamber serves to urge the valve member 45 downward into engagement with the valve seat 44 sealing the passage 43 from the chamber to the siphon 15. Contraction of the air 38 within the chamber 35 provides a subatmospheric pressure in the chamber which urges the valve member 45 away from the valve seat 44 opening the passage 43 to the siphon 15 through the pipe 39.

As shown in FIGS. 2 and 4 there is provided a second valve means between the chamber 35 and the space outside the container 28 such as the chamber exhaust valve 49 mounted on the case 34 and in alignment with a passage 52 in the plate 32 leading to the chamber. The exhaust valve 49 as shown more clearly in FIG. 4 is a ball check valve having a valve member such as ball 53 which is biased by a spring 54 toward a closed position with the ball in sealing relationship with a valve seat 55. When an increasing air pressure within the chamber 35 exceeds a predetermined level the force exerted by the spring 54 is overcome and the ball 53 is adapted to move away from the valve seat 55 and permit the exhausting of air from the interior of the chamber into the atmosphere. When the interior of the chamber 35 is cooled (due to either the cool of the evening or due to cloud covering) and the air pressure within the chamber is reduced the force of the spring 54 is adapted to move the ball 53 into sealing engagement with the valve seat 55 to thereby prevent flow of air from the space outside the chamber into the chamber.

A third valve means such as outlet valve 56 is mounted on the outlet end 17 of the discharge hose 16 and as shown in FIG. 6 is in the form of a ball check valve having a ball 57 and a spring 58 for biasing the ball towards a valve seat 59. When the weight of the water drawn into hose 16 exceeds a predetermined value (which corresponds with the condition in which the siphon 15 is "filled" with water), the resilience of the spring 58 is such that it will be overcome by the weight of the water and the ball 57 will move away from the valve seat 59 permitting flow of the water through the siphon and operation thereof. At other times the resilience of the spring 58 will urge the ball 57 into sealing engagement with the valve seat 59 and prevent flow of gaseous fluid at atmospheric pressure into the discharge hose 16 of the siphon 15.

In operation of the apparatus of the invention the inlet hose 18 is extended from the roof drain pipe 12 to the standing water 11 or the area where it accumulates on a roof 10 and the inlet end 22 and the strainer 23 positioned on the roof with the supporting edge 25 in engagement with the roof surface 14. After a rain the standing water 11 will accumulate and the inlet end 22 of the inlet hose 18 will be immersed in the standing water.

When the sun is exposed to the chamber 35 the radiant energy from the sun heats and expands the air 38 within the chamber through the disc 36 which absorbs radiant energy from the sun and transfers the radiant energy by conduction to the air within the chamber. As the air 38 expands within the chamber 35 the pressure increases to the predetermined point where exhaust valve 49 is opened and a portion of the air within the chamber is exhausted into the space outside the chamber. After this air has been exhausted the pressure within the chamber 35 will be reduced and the exhaust valve 49 closed preventing further communication of air between the atmospheric outside the chamber and the chamber itself. Then during the cool evening hours or during periods of cloud coverage of the sun the interior of the chamber 35 cools and the air therein contracts. The suction effect of the contracting air and the attendant reduction in air pressure within the chamber 35 opens the check valve 42 between the chamber and the siphon 15.

The resulting subatmospheric pressure is communicated to the siphon 15 and water 11 is drawn into the inlet hose 18 from the inlet end 22 until the pressure within the chamber 35 is equal to the pressure in the siphon 15. At this point the check valve 42 is closed and the cycle of heating the air 38 in the chamber 35, exhausting the excess air through exhaust valve 49 and then creating a subatmospheric pressure in the chamber by cooling of the remaining air is repeated whereupon further water 11 is drawn into the siphon 15 until the discharge hose 16 is filled.

At this time the outlet valve 56 will be opened and the siphon 15 will operate to transfer water from the upper level of the standing water I—I to the lower level of the outlet 0—0 as shown in FIG. 2. The check valve 42 will remain closed during this operation because the pressure within the siphon 15 will be less than or equal to the pressure within the chamber 35. This operation will continue until the level of the standing water I—I drops to the point where the inlet end 22 and strainer 23 are no longer immersed in the standing water 11. At that time the outlet valve 56 will automatically close and the siphon drain apparatus will be ready for automatic operation after the next rain or accumulation of melting ice and snow.

It is evident that although only one inlet hose 18 is shown for this embodiment additional inlet hoses may be connected to the Tee connection 19 or a similar connection for draining standing water from other areas of a roof. All that would be entailed would be the provision of a float valve to close the inlet ends of the inlet hoses where the standing water has been drained off so that the siphon will continue to operate for those areas where the water still is standing.

It also is evident that various types of pressure sensitive valves can be used in place of the valve seat check valve 42 and the ball type check valves 49 and 56 described.

With the foregoing disclosure in mind, many and varied obvious modifications of this invention will become readily apparent to those of ordinary skill in the art.

Therefore, what is claimed is:

1. A solar actuated siphon for transferring liquid from an upper level to a lower level, said siphon having an inlet for immersion in said liquid at said upper level and an outlet at said lower level, an enclosed container having a chamber in communication with said siphon, first valve means between said siphon and said chamber, said first valve means being responsive to open when gaseous fluid pressure in said chamber is less than the fluid pressure in said siphon and to close when the fluid pressure in said chamber is greater than the fluid pressure in said siphon, second valve means between said chamber and the space at atmospheric pressure outside said container, said second valve means being responsive to open when the gaseous fluid pressure in said chamber is greater than atmospheric pressure by a predetermined amount and to close at lower fluid pressures, a third valve means at said outlet being responsive to open when the fluid pressure in said siphon exceeds atmospheric pressure by a predetermined amount and to close at lower fluid pressure, means associated with said chamber for absorbing radiant solar energy to heat and thereby increase the pressure of gaseous fluid within said chamber, said second valve means being responsive to the increased pressure of said gaseous fluid to permit ejection of a portion of said gaseous fluid from said chamber, and said first valve means being responsive to a reduction in pressure of the remaining portion of gaseous fluid within said chamber on cooling causing said first valve means to open and communicate the resulting subatmospheric pressure in said chamber to said siphon, said third valve means maintaining a closed outlet and said subatmospheric pressure being communicated to said siphon and said inlet causing said liquid from said upper level to flow into said siphon and towards said outlet, said third valve means opening upon filling of said siphon with said liquid whereby said liquid is transferred from said upper level to said lower level.

2. A solar actuated siphon according to claim 1 wherein said siphon includes a first tubular member extending from said container to said outlet and a second tubular member extending from said inlet to said first tubular member at a connection between said container and said outlet.

3. A solar actuated siphon according to claim 2 wherein said inlet includes a strainer member mounted on said second tubular member, said strainer member being in the form of a cup having a base and a projecting supporting edge, said second tubular member being mounted on said base and a screen positioned over the entrance to said second tubular member.

4. A solar actuated siphon according to claim 1 wherein said means for absorbing radiant solar energy comprises a substantially black body within said chamber and said container has a substantially transparent wall over said black body for transmittal of solar radiation to said body.

5. A solar actuated siphon according to claim 4 wherein said black body is of aluminum and said transparent wall is a dome of transparent plastic material.

6. A solar actuated siphon to claim 3 wherein said siphon is adapted for draining standing water from a roof having a drain pipe located at a position spaced from said standing water, said container being located above said drain and said first tubular member extending into said drain.

7. A solar actuated siphon according to claim 5 wherein said container is supported in an elevated position by legs extending from said container to said roof.

8. A solar actuated siphon according to claim 1 wherein said first valve means includes a check valve having a passage between said chamber and said siphon, a valve member in said passage blocking flow of gaseous fluid from said chamber to said siphon and permitting flow of gaseous fluid from said siphon to said chamber.

* * * * *